United States Patent [19]

Krumreich

[11] 3,990,764

[45] Nov. 9, 1976

[54] CONNECTOR

[75] Inventor: Charles Louis Krumreich, Indianapolis, Ind.

[73] Assignee: Bell Telephone Laboratories, Incorporated, Murray Hill, N.J.

[22] Filed: Jan. 12, 1976

[21] Appl. No.: 648,280

Related U.S. Application Data

[63] Continuation of Ser. No. 504,081, Sept. 9, 1974.

[52] U.S. Cl. ..... 339/176 M; 339/196 A; 339/244 R

[51] Int. Cl.[2] ..... H01R 13/72; H01R 33/16

[58] Field of Search ..... 339/48, 49 R, 49 B, 339/174, 175, 91 R, 244 R, 176, 217 S, 195 M, 196 M, 211

[56] References Cited

UNITED STATES PATENTS

| | | | |
|---|---|---|---|
| 2,032,470 | 3/1936 | Chirelstein | 339/196 R |
| 2,236,167 | 3/1941 | David | 339/65 |
| 2,431,366 | 11/1947 | Buell | 339/217 S |
| 3,217,285 | 11/1965 | Barre | 339/49 R |
| 3,226,668 | 12/1965 | Baer et al. | 339/91 R |
| 3,654,592 | 4/1972 | Primorac | 339/176 MP |
| 3,688,243 | 8/1972 | Yamada et al. | 339/49 R |
| 3,699,498 | 10/1972 | Hardesty et al. | 339/91 R |
| 3,706,954 | 12/1972 | Krafthefer | 339/91 R |
| 3,798,588 | 3/1974 | Howe et al. | 339/176 L |
| 3,827,007 | 7/1974 | Fairbairn et al. | 339/49 R |
| 3,901,575 | 8/1975 | Hoover | 339/49 R |

*Primary Examiner*—Joseph H. McGlynn
*Assistant Examiner*—Craig R. Feinberg
*Attorney, Agent, or Firm*—Harry L. Newman

[57] ABSTRACT

A connector in accordance with the present invention comprises a dielectric contact carrier including a multiplicity of orifices extending from the front to the rear thereof in which a multiplicity of contact spring assemblies are respectively mounted. The free ends of the spring contacts are bent over so that they extend rearwardly cantilever fashion beneath the carrier and a wedge shaped latch extends upwardly from the carrier. The carrier is accommodated by an opening in the rear of a dielectric support, the opening leading to a carrier receiving cavity in the upper portion of the support and the upper surface of the cavity including a recess for accommodating the latch of the carrier. The support further includes a plug receiving cavity open to the front of the support that is situated beneath the carrier receiving cavity, and a slotted wall for constraining the free ends of the cantilever portions of the spring contacts is located at the rear of the plug receiving opening. The open ends of the slots are adjacent to the carrier receiving opening, and the slots are equal in number to the wire spring contacts and laterally spaced the same distance apart as the fixed ends of the cantilever portions.

4 Claims, 7 Drawing Figures

CONNECTOR

CROSS REFERENCE TO RELATED APPLICATION

This application is a continuation of my copending application, Ser. No. 504,081, filed Sept. 9, 1974.

FIELD OF THE INVENTION

This invention relates to the field of electrical connectors and within that field to female type connectors referred to in general as sockets and in the telephone art as jacks.

BACKGROUND OF THE INVENTION

The direction of electrical technology today is toward smaller and smaller components, and this is no less true with respect to electrical connectors than it is with respect to other discrete components. However, one major problem in this movement toward miniaturization of connectors is manufacturability. As connectors become smaller, they typically become more difficult and consequently more expensive to manufacture.

The copending application of C. L. Krumreich, A. E. Mulbarger, Jr. and S. W. Walden, now U.S. Pat. No. 3,850,497, discloses a socket that lends itself to miniaturization and to automated assembly of many of its components. The socket commprises a dielectric support having a plug receiving cavity open to the front of the support and a multiplicity of spaced orifices that extend from the front to the rear of the support along one side of the cavity. Each orifice accommodates a contact spring assembly consisting of a conductive splicing member, an insulated conductor, and a wire spring contact, the splicing member physically clamping and thereby electrically connecting a bared end of the insulated conductor to an end of the wire spring contact. Automated machinery is used to not only assemble the contact spring assemblies but to also (1) insert them into the orifices in the support so that the free ends of the wire spring contacts extend out the front ends of the orifices and (2) bend the free ends of the wire spring contacts over so that they extend rearwardly cantilever fashion within the plug receiving cavity of the support.

The cantilever portions of the wire spring contacts provide the electrical connection with the mating plug, and if it is satisfactory to have the free ends of the cantilever portions remain unconstrained, then the support can be molded in one piece and no further assembly operations are necessary. However, generally this arrangement is satisfactory only if two conditions exist. First, the mating plug, like the plug disclosed in U.S. Pat. No. 3,761,869 issued to E. C. Hardesty, C. L. Krumreich, A. E. Mulbarger, Jr. and S. W. Walden on Sept. 25, 1973, includes means, such as grooves, for locating the cantilever portions in registration with the contact members of the plug. Second, the use of the socket is such that power is applied to the contacts thereof only when in engagement with the contacts of the plug. If one or the other of these conditions does not exist, then it is generally desirable to constrain the free ends of the cantilever portions in a lateral direction in order to assure their alignment with the contacts of the mating plug and prevent the possibility of one cantilever portion being shorted against another cantilever portion during the time that the mating plug is removed.

The constraint provided in one embodiment of the Krumreich et al U.S. Pat. No. 3,850,497 comprises a multiplicity of vertical slots in a wall at the rear of the plug receiving cavity. The slots, which are equal in number to the wire spring contacts and laterally spaced the same distance apart as the fixed ends of the cantilever portions, receive the free ends of the cantilever portions. Because it is difficult to bend the wire spring contacts and place them in the associated slots at the same time, it is necessary to introduce additional assembly steps in order to incorporate this constraint.

Thus in one embodiment of the copending application the support consists of two members, a first of which comprises just the one wall of the plug receiving cavity that includes the orifices in which the contact spring assemblies are supported and the second of which comprises the balance of the support including the slotted wall. With this configuration the additional assembly steps consist of locating the two support members in registration with one another, positioning the free ends of the cantilever portions within the slots of the slotted wall, and ultrasonically or adhesively bonding the two support members together.

Since the bonding of the two support members is performed subsequent to the mounting of the contact spring assemblies in and the forming of the cantilever portions beneath the first support member, the cantilever portions can be readily positioned within the slots by using the slotted wall as a comb that is slid over the cantilever portions as the two support members are placed in registration with one another. However, ultrasonic bonding is at the present time as much of an art as it is a science, and it is difficult to consistently obtain bonds of uniform strength. Adhesive bonding, on the other hand, does not lend itself to large scale production.

Another approach to providing the desired constraint for the cantilever portions comprises molding the support as a unitary member with the slotted wall separate from but joined to the rear of the support by a plastic hinge and with the slotted wall configured so as to be snapped into place at the rear of the plug receiving cavity. With this design the bonding of two support members together is eliminated, but locating the free ends of the cantilever portions within the respective slots of the slotted wall as the wall is being snapped into place is a difficult operation.

SUMMARY OF THE INVENTION

The connector of the present invention provides the desired lateral constraint for the free ends of the cantilever portions without the need for bonding two support members together and in a manner that facilitates the positioning of the free ends of the cantilever portions in the constraining element.

A connector in accordance with the present invention comprises a dielectric contact carrier including a multiplicity of orifices extending from the front to the rear thereof in which the contact spring assemblies of the Krumreich et al. U.S. Pat. No. 3,850,497 are mounted. The free ends of the spring contacts are bent over so that they extend rearwardly cantilever fashion beneath the carrier and a wedge shaped latch extends upwardly from the carrier. The carrier is accommodated by an opening in the rear of a dielectric support, the opening leading to a carrier receiving cavity in the upper portion of the support and the upper surface of the cavity including a recess for accommodating the latch of the carrier. The support further includes a plug receiving cavity open to the front of the support that is situated beneath the carrier receiving cavity, and a slotted wall for constraining the free ends of the cantilever portions of the spring contacts is located at the rear of the plug receiving opening. The open ends of the slots are adjacent to the carrier receiving opening, and the slots are equal in number to the wire spring contacts and laterally spaced the same distance apart as the fixed ends of the cantilever portions.

As the front end of the carrier is inserted into the carrier receiving cavity of the support, the portions of the cantilever portions adjacent the fixed ends thereof move into juxtaposition with the slots of the slotted wall. Because these portions have approximately the same spacing as the fixed ends, they automatically move into the slots. In addition, as the insertion of the carrier into the carrier receiving cavity continues, the cantilever portions engage and then are deflected upward by the bottom of the slots. Thus when the carrier is fully positioned within the carrier receiving cavity, an upward bias is provided that maintains the latch of the carrier within the associated recess of the support and thereby secures the carrier to the support. Furthermore, when the mating plug is inserted into the plug receiving cavity of the support, the cantilever portions are deflected still further. The upward bias on the carrier is thereby increased, whereby the possibility of the carrier being displaced rearwardly by the rearward insertion of the plug is eliminated. Thus it is seen that the constraint for the free ends of the cantilever portions is provided in a relatively simple manner that lends itself to automation.

DETAILED DESCRIPTION OF THE INVENTION

Figure 1:
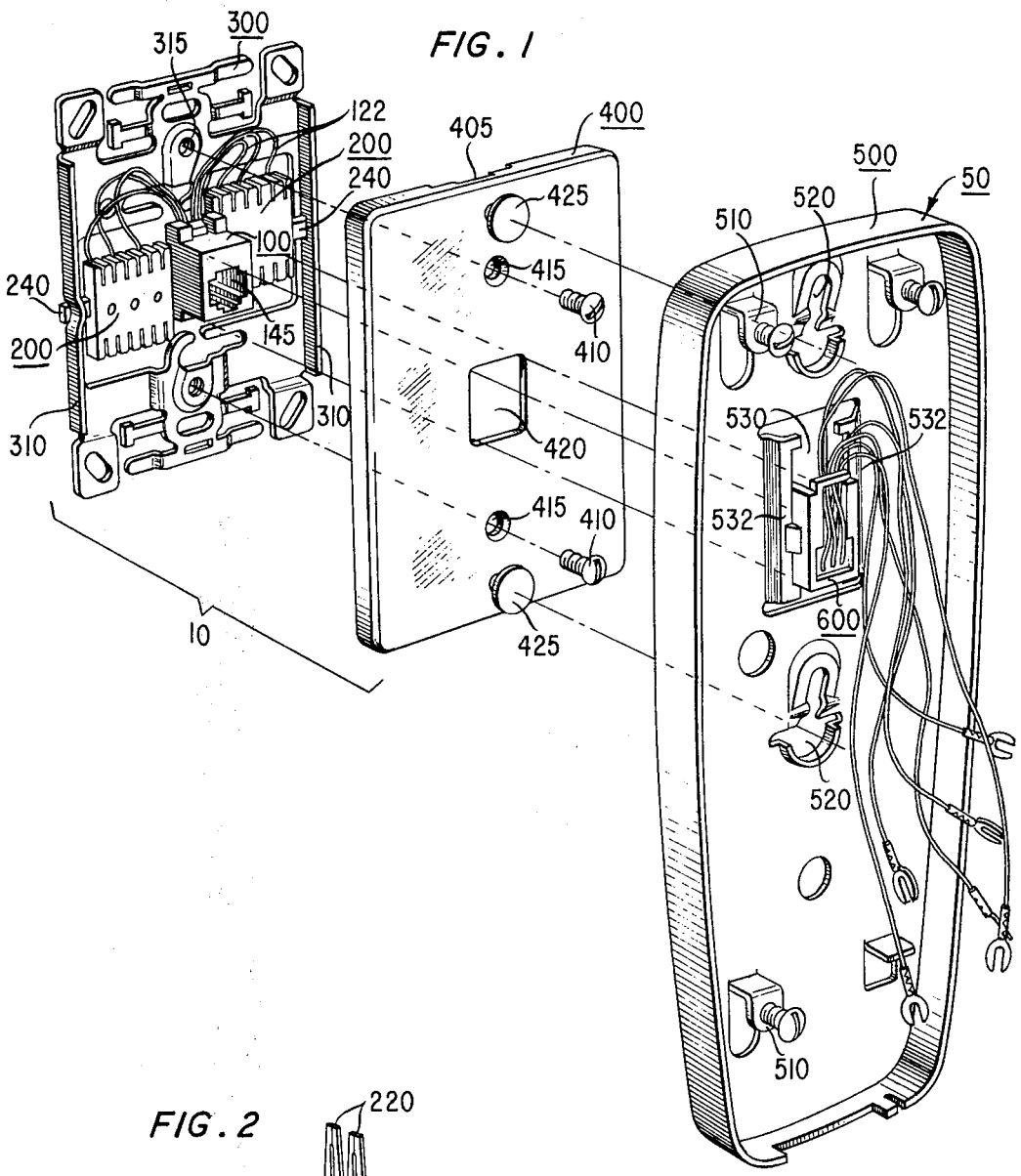
FIG. 1 is an exploded perspective view of a wall mounting and a wall telephone base mounting adapted to mate therewith, the wall mounting incorporating a jack in accordance with the present invention.

Referring to FIG. 1 of the drawing, there is shown an arrangement for providing plug-in installation of a wall telephone set. The arrangement consists of a wall mounting 10 that is secured to a wall at the site at which the wall telephone set is to be located and a base mounting 50 that is secured to the base of the wall set. The wall mounting 10 includes an electrical socket 100 in accordance with the present invention, the socket being referred to in telephone parlance as a jack.

Figure 2:
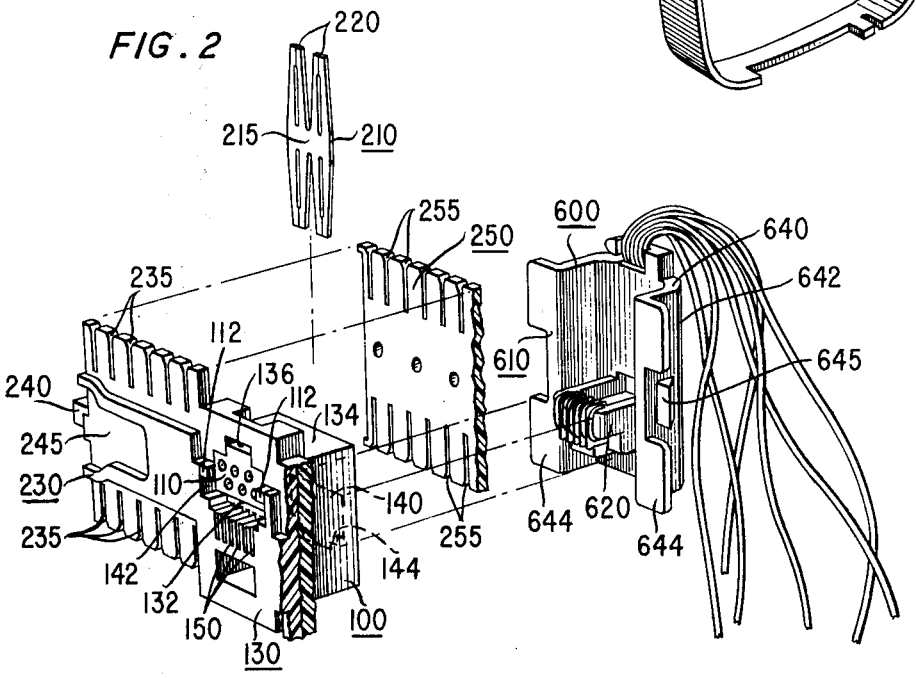
FIG. 2 is an enlarged exploded perspective view with portions broken away showing the jack of the wall mounting and a plug of the base mounting in greater detail.
Figure 3:
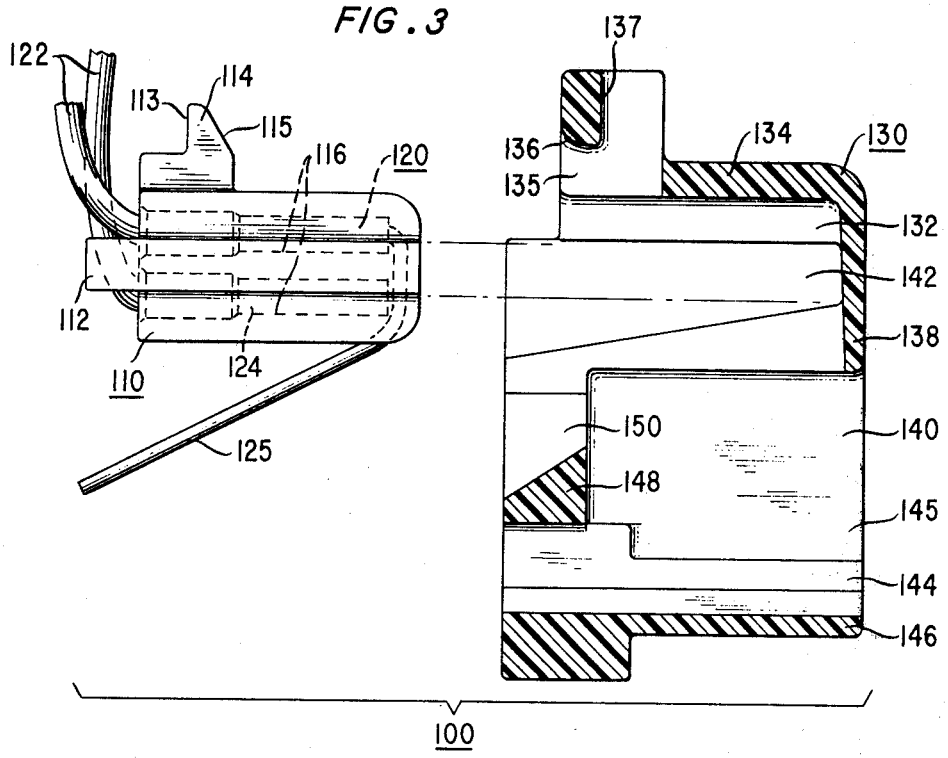
FIG. 3 is an exploded side view partially in section showing a carrier and support that comprises the jack, the carrier being shown in position to be inserted into the support.

As shown in FIGS. 2 and 3, the jack 100 includes a unitary dielectric contact carrier 110 that has a generally rectangular box-like shape except that it has a tongue 112 extending along each side thereof and a latch 114 upstanding from the top thereof. The latch 114 has a wedge-shaped profile in that it includes a rearward or trailing blocking surface 113 that extends perpendicularly to the top of the carrier 110 and a forward or leading cam surface 115 that is inclined to the top of the carrier and the blocking surface.

The carrier 110 also has a plurality of spaced orifices 116 extending therethrough from the front to the rear thereof. The orifices 116 are shaped in the same manner as those in the connector disclosed in the previously referred to Krumreich et al. patent, that is, they include a bore portion at the forward end thereof and a counterbore portion at the rear end thereof. In addition, as in the Krumreich et al. patent, the front ends of the orifices 116 respectively communicate with a plurality of parallel grooves (not shown), each of which extends from the associated orifice to the underside of the carrier 110.

Each orifice 116 accommodates a contact assembly 120 that, since it is the same as that disclosed in the Krumreich et al. patent, need not be described in detail here. Briefly, it comprises an insulated lead wire 122, a conductive splicing member 124, and a wire spring contact 125, the splicing member physically clamping and thereby electrically connecting a bared end of the lead wire to an end of the wire spring contact. Each spring contact 125 is formed to provide a first portion that lies within the associated groove at the front of the orifice 116 and a second portion that extends rearwardly cantilever fashion beneath the bottom of the carrier.

The contact carrier 110 is accommodated by an opening in the rear of a unitary dielectric support 130, the opening leading to a carrier receiving cavity 132 in the upper portion of the support. The ceiling of the cavity 132, defined by a top wall 134 of the support 130, has a recess 135 therein for receiving the latch 114 of the carrier 110, and the entrance of the cavity includes a rounded cam surface 136 leading to the latch receiving recess that cooperates with the cam surface 115 of the latch, while the rear of the recess includes a vertical blocking surface 137 that cooperates with the blocking surface 113 of the latch. The front and sides of the cavity 132 are respectively defined by a front wall 138 and side walls 140 of the support 130, and the sides of the cavity are spaced slightly farther apart than the sides of the carrier 110. In addition, the sides of the cavity 132 include opposed grooves 142 for accommodating the tongues 112. The grooves 142 taper toward the front of the cavity 132 and the tops of the grooves extend in a horizontal plane while the bottoms are inclined. Furthermore, the sides of the grooves 142 are spaced slightly farther apart than the sides of the tongues 112.

The support 130 further includes a plug receiving cavity 144 that is open to the front of the support and is situated beneath the carrier receiving cavity 132, and the two cavities are in full communication with one another in that no partition separates the bottom of the carrier receiving cavity from the top of the plug receiving cavity. The sides and bottom of the plug receiving cavity 144 are respectively defined by the side wall 140 and a bottom wall 146 of the support 130, the side walls including generally square shaped recesses 145. The rear of the cavity 144 is defined by a wall 148 situated below the entrance to the carrier receiving cavity 132, and the wall has a plurality of slots 150 therein, the upper ends of which are open. The slots 150 are equal in number to the contact assemblies 120, are somewhat wider than the diameter of the spring contacts 125, and are laterally spaced the same distance apart as the fixed ends of the cantilever portion of the spring contacts. In addition, the slots 150 are spaced approximately in the same distance from the sides of the carrier receiving cavity 132 as the fixed ends of the associated cantilever portions are spaced from the sides of the carrier 110. Finally, the slots 150 are of uniform depth and the bottoms of the slots provide a contact engaging surface that is spaced a particular distance from the top of the grooves 142 in the sides of the cavity 132. In the embodiment shown, the bottoms of the slots 150 are inclined and the upper edges of the bottoms provide the contact engaging surface.

As a result of these relationships, when the contact carrier assembly 110 is oriented with respect to the support 130 in the manner shown in FIG. 3 and the front end of the carrier is inserted into the carrier receiving cavity 132 with the tongues 112 positioned within the grooves 142, the front portions of the cantilever portions of the spring contacts 125 move into juxtaposition with the open ends of the slots 150 in the wall 148. Since these portions of the cantilever portions have approximately the same spacing as the fixed ends, they automatically move into the slots 150.

Figure 4:
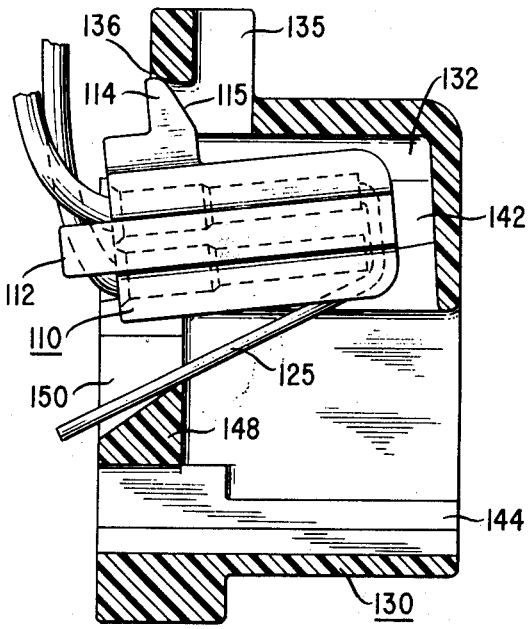
FIG. 4 is a side view partially in section showing the interaction between the carrier and support as the carrier is inserted into a carrier receiving cavity in the support.

Furthermore, as shown in FIG. 4, as the insertion of the contact carrier 110 into the carrier receiving cavity 132 continues, the inclined cam surface 115 of the latch 114 engages the rounded cam surface 136 at the entrance to the cavity. The interaction between these two surfaces deflects the rear end of the carrier downwardly, the front end of the carrier being restrained by the interaction of the bottom front edges of the tongues 112 with the bottoms of the tapered grooves 142. At about the same time, the cantilever portions of the spring contacts 125 engage the bottoms of the slots 150, and as the forward movement of the carrier 110 continues, the cantilever portions are deflected upwardly. Thus the movement of the latch 114 of the carrier 110 into the portion of the cavity 132 leading to the latch receiving recess 135 results in an upward bias on the carrier such that when the latch moves into juxtaposition with the recess, the carrier is snapped upward, moving the latch into the recess and moving the top of the tongues 112 against the top of the grooves 142.

Figure 5:
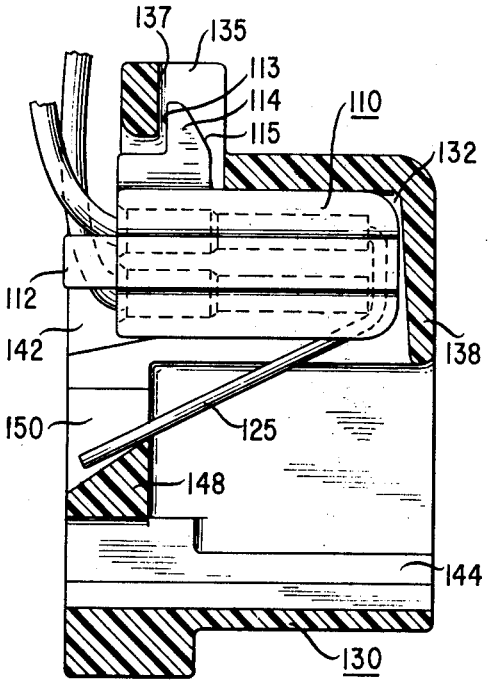
FIG. 5 is a side view partially in section showing the carrier fully seated within the support.

As shown in FIG. 5, this occurs at essentially the same time that the contact carrier 110 is fully inserted into the carrier receiving cavity 132, and the length of the cantilever portions of the spring contacts 125 is selected so that with the carrier so positioned, the free ends of the cantilever portions are respectively located in the slots 150 of the wall 148. The cantilever portions are thereby constrained so that they are spaced from and extend parallel to one another. In addition, the distance between the contact engaging surfaces of the slots 150 and the tops of the grooves 142 is selected so that with the carrier 110 fully positioned within the cavity 132, the free ends of the cantilever portions of the spring contacts are deflected upward from the position they would occupy if they were unconstrained. Furthermore, this distance is selected so that the bias provided by the upward deflection of the cantilever portions of the spring contacts 125 is sufficient to maintain the tongues 112 against the tops of the grooves 142. The latch 114 is thereby positioned within the latch receiving recess 135, whereby forward movement of the carrier 110 is prevented by the front wall 138 of the support 130 and rearward movement is prevented by interaction between the blocking wall 113 of the carrier and blocking wall 137 of the support. As a result, the carrier 110 is secured in place. Finally, as shown in FIG. 5, the cantilever portions of the spring contacts 125 extend into the plug receiving cavity 145 of the support 130 whereby they are in position to be engaged by the contacts of the mating plug.

Referring again to FIGS. 1 and 2, the jack 100 is straddled by a pair of quick-connect connecting block assemblies 200 of the type disclosed in U.S. Pat. No. 3,798,587 issued to B. C. Ellis, Jr., C. S. Scholly, C. McGonical and J. H. Snyder on Mar. 19, 1974. As shown more clearly in FIG. 2, each connecting block assembly 200 comprises three electrically conducting, insulation piercing terminal pairs 210 (only one of which is shown) captured between a dielectric rear wall 230 and a dielectric front wall 250. Each terminal pair 210 consists of a central body portion 215 having oppositely extending bifurcated portions 220 cantilevered therefrom, the free ends of each bifurcated portion being formed with a V-notch in plan view and a double bevel in profile view. The root of the V-notch is at the juncture of the furcations, and when an insulated conductor is pressed against the free end of a bifurcated portion 220, the beveled edges slice through the insulation while the V-notch directs the bared conductor between the furcations. The bared conductor spreads the furcations apart and the spring force thereby generated clamps the conductor in place and provides a good electrical connection between the conductor and the terminal pair.

Partitions (not shown) formed in the rear wall 230 locate each terminal pair 210 with the junctures between furcations centered within slots 235 in the wall, and the front wall 250 when joined to the rear wall cooperates with the partitions to secure the terminal pairs in place. The front wall 250 has slots 255 corresponding to and located in alignment with the slots 235 in the rear wall 230, and the aligned slots serve to hold an insulated conductor in place prior to its insertion between the furcations of a terminal pair 210. As indicated in FIG. 1, each lead wire 122 of the jack 100 is connected to an individual terminal pair 210.

The rear walls 230 are advantageously formed integral to the jack 100 whereby the jack and straddling connecting block assemblies 200 form a subassembly of the wall mounting 10. In addition, the rear walls 230 include a lug 240 at the remote end thereof and a shaped depression 245 in the rear surface thereof that are used to secure the subassembly to the center of a bracket 300. The bracket 300 includes sides 310 having openings therein for accommodating the lugs 240 and a pair of tabs (not shown) extending laterally toward one another from the sides that conform to the shaped depressions 245. Thus when the subassembly is positioned on the bracket 300 with these associated elements in engagement, the subassembly is secured in place by merely bending the left side 310 over the associated lug 240.

The bracket 300 is configured so that it can be fastened directly to a wall surface, to a standard recessed electrical box, or to a standard recessed telephone box. As a result, the jack can be connected to telephone line conductors that are either run along the surface of a wall or concealed behind the wall. Connection between the line conductors and the jack leads is achieved by merely inserting each line conductor into engagement with the appropriate terminal pair 210.

The wall mounting is completed by a faceplate 400 that encompasses the bracket 300 on all four sides, the faceplate having an opening 405 in the top and bottom edges thereof for receiving surface run conductors. The faceplate 400 is attached to the bracket 300 by fasteners 410 that are inserted through holes 415 in the faceplate and threaded into holes 315 in the bracket. When so attached, the forward end of the jack 100 protrudes through an opening 420 in the faceplate 400 and a pair of nail head studs 425 straddle and are in vertical alignment with the opening. The studs 425 support and secure the base mounting 50 to the wall mounting 10.

The base mounting 50 consists of a base pan 500 and a plug 600, the base pan including means 510 for securing it to the base of a telephone set. The base pan 500 further includes a pair of key hole slots 520 that straddle and are in vertical alignment with a rectangular opening 530, the sides of which are formed to provide rails 532. The key hole slots 520 are spaced the same distance apart as the nail head studs 425 of the faceplate 400, and enlarged lower portions of the slots are of a size to accommodate the heads of the studs while the narrow upper portions of the slots are of a size to accommodate the shanks of the studs.

The plug 600 includes a unitary dielectric support 610 comprising a plug portion 620 extending from a U-shaped base portion 640. Sides 642 of the base portion 640 are relatively flexible, and each side includes a flange 644 at the end thereof and a wedge-shaped boss 645 adjacent to the flange. The flanges 644 extend in opposite directions from one another, and the base portion 640 is of a size that by moving the rear of the base portion into the opening 530 in the base pan 500, inclined surfaces of the bosses 645 engage the rails 532 at the sides of the opening. Then by pushing the base portion 640 further into the opening 530, the sides 642 are deflected toward one another far enough to permit the bosses 645 to pass through the opening, whereupon the sides snap away from each other and rails 532 are captured between the flanges 644 and the bosses. The support 610 is then movable up and down along the length of the rails 532.

Figure 6:
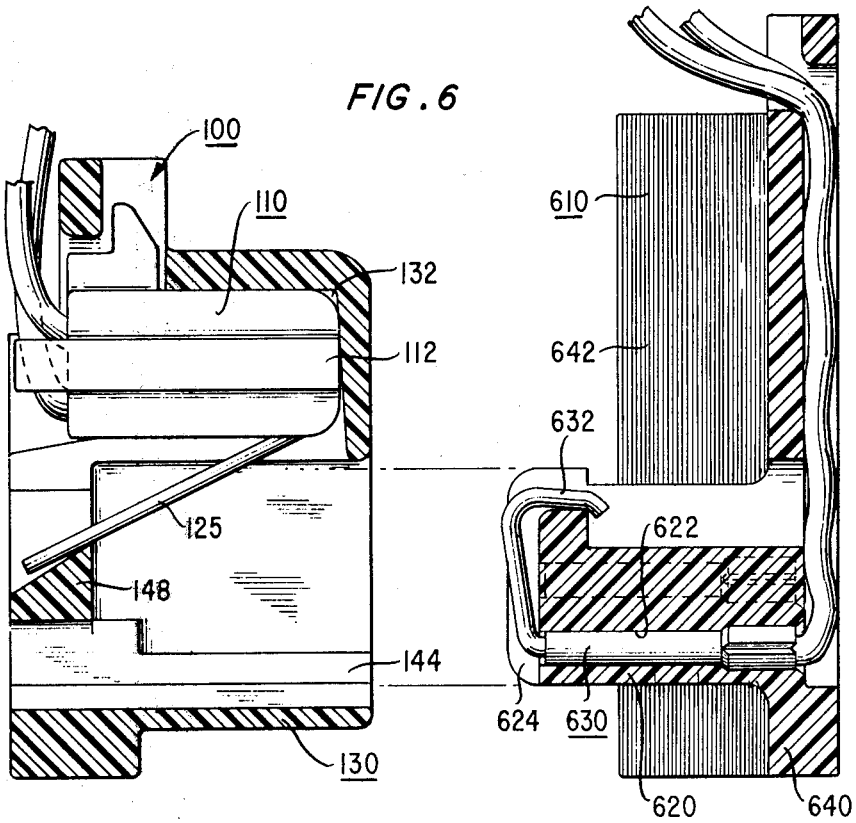
FIG. 6 is an exploded side view partially in section showing the plug of the base mounting in position to be inserted into the jack.
Figure 7:
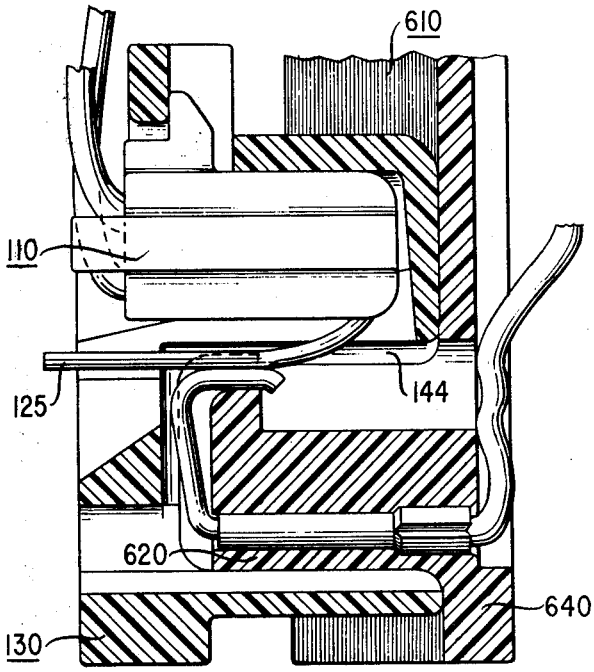
FIG. 7 is a side view partially in section showing the plug of the base mounting inserted into engagement with the jack.

Referring now also to FIGS. 6 and 7, the plug portion 620 of the support 610 is of a size and shape to essentially fill the plug receiving cavity 144 of the jack 100, and it includes a plurality of spaced orifices 622 extending therethrough from the front to the rear thereof that are equal in number to and of the same shape as those in the carrier 110 of the jack 100. Furthermore, the orifices 622 respectively communicate with a plurality of parallel grooves 624 which extend both along the front and the top of the plug portion 620. Each orifice 622 accommodates a contact assembly 630 that is the same as the contact assemblies 120 (FIG. 3) of the jack 100 except that spring contacts 632 of the contact assemblies 630 are shorter and are formed so as to be constrained within the grooves 624. The lateral spacing between the spring contacts 632 is identical to that of the spring contacts 125 of the jack 100.

When the plug 600 is positioned at the bottom of the opening 530 in the base pan 500, the plug portion 620 is able to move into the plug receiving cavity 144 of the jack 100 at the same time that the nail head studs 425 on the faceplate 400 move into the enlarged lower portions of the key hole slots 520 in the base pan. As the plug portion 620 moves into the plug receiving cavity 144, the spring contacts 632 thereof engage the cantilever portions of the spring contacts 125 and deflect them upward. The upward bias on the carrier 110 is thereby increased and the possibility of the carrier being dislodged from the support 130 by the movement of the plug portion 620 toward the rear of the jack 100 is eliminated.

The plug portion 620 is fully positioned within the cavity 144 at the same time that the heads of the nail head studs 425 have passed through to the other side of the key slots 520 and the shanks of the studs are positioned within the slots. The base mounting 50 is then secured to the wall mounting 10 by merely moving the base pan 500 downward to position the narrow upper portion of the slots 520 over the shanks of the studs 425. The surface surrounding the narrow upper portions of each slot 520 is advantageously formed to provide an inverted U-shaped wedge that eliminates any play between the base mounting 50 and the wall mounting 10. In addition, a boss is advantageously provided at each end of the wedge that engages the lower end of the head of the associated stud 425 and thereby captures the stud in the upper portion of the key hole slot 520.

It is to be understood that the embodiment described herein is merely illustrative of the principles of the invention. Various modifications may be made thereto by persons skilled in the art without departing from the spirit and scope of the invention.

It is to be expressly understood that the connector of this invention performs equally well in any orientation and the terms front, upper, bottom, and so forth appearing in the claims are employed to establish relative positions between the elements of the connector and do not limit the connector to any particular orientation.

What is claimed is:

1. A connector comprising:

a dielectric contact carrier having locating means extending along at least one side thereof and a latch extending upwardly therefrom, the latch comprising a rigid protuberance, the trailing surface of which extends transversely to the top of the carrier to provide a blocking surface;

a plurality of spaced spring contacts mounted on the carrier, each spring contact including a cantilever portion extending beneath the carrier;

a dielectric support having a cavity into which the carrier is inserted, the upper surface of the cavity including a recess for accommodating the latch when the carrier is fully inserted into the cavity and the side of the cavity including locating means complementary to the locating means of the carrier for cooperating with the locating means of the carrier, both locating means including a first surface that is positioned adjacent to the first surface of the other locating means when the carrier is fully inserted into the cavity, and one locating means including a second surface that is opposed to the first surface thereof and extends along its length at an acute angle to the first surface, the spacing between the first and second surfaces being such as to permit the carrier to be deflected transversely to its direction of insertion, the support further including an integral contact engaging surface located so as to deflect the cantilever portions of the spring contacts upward when the carrier is fully inserted into the cavity, and the entrance of the cavity including means adjacent to the latch receiving recess for cooperating with the latch to deflect the carrier transversely to its direction of insertion so as to move the cantilever portions of the contact springs into engagement with the contact engaging surface, the cantilever portions of the spring contacts biasing the carrier so as to move the latch into the latch receiving recess when the carrier is fully inserted into the cavity, the latch receiving recess including a blocking surface extending generally parallel to and in juxtaposition with the blocking surface of the latch for cooperating therewith to prevent rearward movement of the carrier and thereby secure the carrier in place.

2. A connector comprising:

a dielectric contact carrier having a tongue extending along each side thereof and a latch extending upwardly therefrom, the latch comprising a protuberance having a wedge-shaped profile, the trailing surface of the latch extending approximately perpendicular to the top of the carrier to provide a blocking surface and the leading surface of the latch being inclined to the top of the carrier to provide a cam surface;

a plurality of spaced spring contacts mounted on the carrier each spring contact including a cantilever portion extending beneath the carrier;

a dielectric support having a cavity for receiving the carrier, the upper surface of the cavity including a recess for accommodating the latch when the carrier is fully positioned within the cavity and the side of the cavity including opposed grooves for accommodating the tongues of the carrier, the grooves tapering toward the front of the cavity, the support further including a plurality of spaced slots, the upper ends of which are open and are situated adjacent to the carrier receiving cavity, each slot accommodating the cantilever portion of an individual spring contact and including a contact engaging surface located so as to deflect the associated cantilever portion upward when the carrier is fully positioned within the cavity, and the entrance of the cavity including a cam surface adjacent to the latch receiving recess for cooperating with the cam surface of the latch to deflect the carrier toward the contact engaging surfaces of the slots as the carrier is inserted into the cavity, the cantilever portions of the spring contacts biasing the carrier so as to move the latch into the latch receiving recess when the carrier is fully positioned within the cavity, the latch receiving recess including a blocking surface extending generally parallel to and in juxtaposition with the blocking surface of the latch for cooperating therewith to prevent rearward movement of the carrier and thereby secure the carrier in place.

3. A connector as in claim 2 wherein the latch is rigid.

4. A connector as in claim 3 wherein the grooves are tapered along their entire length.

* * * * *